US006769182B1

(12) United States Patent
Mc Cabe

(10) Patent No.: US 6,769,182 B1
(45) Date of Patent: Aug. 3, 2004

(54) CHISEL DEVICE

(76) Inventor: Deron C. Mc Cabe, 200 Rodeo Rd., Ormond Beach, FL (US) 32174

( * ) Notice: Subject to any disclaimer, the term of this patent is extended or adjusted under 35 U.S.C. 154(b) by 161 days.

(21) Appl. No.: 10/006,868

(22) Filed: Oct. 26, 2001

(51) Int. Cl.[7] ..... B25D 3/00

(52) U.S. Cl. ..... 30/164.6; 30/167; 30/277; 81/463

(58) Field of Search ..... 81/463; 72/705; 30/164.6, 277

(56) References Cited

U.S. PATENT DOCUMENTS

| | | | | | |
|---|---|---|---|---|---|
| 1,449,136 | A | | 3/1923 | Yates | |
| 2,475,041 | A | | 7/1949 | Mattson | |
| 2,944,521 | A | | 7/1960 | Kibbe | |
| 3,750,500 | A | * | 8/1973 | Peterson | 81/463 |
| 4,122,699 | A | * | 10/1978 | Logsdon | 72/325 |
| 5,095,784 | A | * | 3/1992 | Garver | 81/466 |
| 5,109,739 | A | * | 5/1992 | Hull et al. | 81/463 |
| 5,113,687 | A | * | 5/1992 | Palmgren | 72/479 |
| D346,103 | S | | 4/1994 | Warner | |
| 5,365,648 | A | | 11/1994 | Fuga | |
| 5,461,900 | A | * | 10/1995 | Gutierrez | 72/479 |
| 5,878,822 | A | | 3/1999 | Roy | |
| 5,913,557 | A | * | 6/1999 | Jarock | 294/15 |
| 5,918,501 | A | * | 7/1999 | Sunaga et al. | 72/479 |
| 2002/0157505 | A1 | * | 10/2002 | Wang | 81/177.1 |
| 2003/0014842 | A1 | * | 1/2003 | Niendorf | 16/430 |

FOREIGN PATENT DOCUMENTS

| | | | | |
|---|---|---|---|---|
| DE | 2344987 A1 | * | 3/1975 | B25G/1/10 |

* cited by examiner

*Primary Examiner*—Allan N. Shoap
*Assistant Examiner*—John Windmuller

(57) ABSTRACT

A chisel device for providing a chisel and slide hammer combination. The chisel device includes an elongated body having a first end and a second end, An annular flange is integrally coupled to and extends around the elongated body. The flange is positioned generally between the first and second ends of the elongated body. The second end comprises a female coupler. A tubular member has an aperture extending therethrough. The elongated body extends through the aperture such that the tubular member is slidably positioned between the flange and the first end of the elongated body such that the tubular member defines a slide hammer. At least one head has a bit portion and a male coupler portion located opposite of each other. The male coupler is adapted for releasably securing to the female coupler.

1 Claim, 2 Drawing Sheets

CHISEL DEVICE

BACKGROUND OF THE INVENTION

1. Field of the Invention

The present invention relates to chisels and more particularly pertains to a new chisel device for providing a chisel and slide hammer combination.

2. Description of the Prior Art

The use of chisels is known in the prior art. More specifically, chisels heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,365,648; U.S. Pat. No. 5,878,822; U.S. Pat. No. 2,475,041; U.S. Pat. No. 2,944,521; U.S. Pat. No. 1,449,136; and U.S. Des. Pat. No. 346,103.

While these devices fulfill their respective, particular objectives and requirements, the aforementioned patents do not disclose a new chisel device. The inventive device includes an elongated body having a first end and a second end. An annular flange is integrally coupled to and extends around the elongated body. The flange is positioned generally between the first and second ends of the elongated body. The second end comprises a female coupler. A tubular member has an aperture extending therethrough. The elongated body extends through the aperture such that the tubular member is slidably positioned between the flange and the first end of the elongated body such that the tubular member defines a slide hammer. At least one head has a bit portion and a male coupler portion located opposite of each other. The male coupler is adapted for releasably securing to the female coupler.

In these respects, the chisel device according to the present invention substantially departs from the conventional concepts and designs of the prior art, and in so doing provides an apparatus primarily developed for the purpose of providing a chisel and slide hammer combination.

SUMMARY OF THE INVENTION

In view of the foregoing disadvantages inherent in the known types of chisels now present in the prior art, the present invention provides a new chisel device construction wherein the same can be utilized for providing a chisel and slide hammer combination.

The general purpose of the present invention, which will be described subsequently in greater detail, is to provide a new chisel device apparatus and method which has many of the advantages of the chisels mentioned heretofore and many novel features that result in a new chisel device which is not anticipated, rendered obvious, suggested, or even implied by any of the prior art chisels, either alone or in any combination thereof.

To attain this, the present invention generally comprises an elongated body having a first end and a second end. An annular flange is integrally coupled to and extends around the elongated body. The flange is positioned generally between the first and second ends of the elongated body. The second end comprises a female coupler. A tubular member has an aperture extending therethrough. The elongated body extends through the aperture such that the tubular member is slidably positioned between the flange and the first end of the elongated body such that the tubular member defines a slide hammer. At least one head has a bit portion and a male coupler portion located opposite of each other. The male coupler is adapted for releasably securing to the female coupler.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new chisel device apparatus and method which has many of the advantages of the chisels mentioned heretofore and many novel features that result in a new chisel device which is not anticipated, rendered obvious, suggested, or even implied by any of the prior art chisels, either alone or in any combination thereof.

It is another object of the present invention to provide a new chisel device which may be easily and efficiently manufactured and marketed.

It is a further object of the present invention to provide a new chisel device which is of a durable and reliable construction.

An even further object of the present invention is to provide a new chisel device which is susceptible of a low cost of manufacture with regard to both materials and labor, and which accordingly is then susceptible of low prices of sale to the consuming public, thereby making such chisel device economically available to the buying public.

Still yet another object of the present invention is to provide a new chisel device which provides in the apparatuses and methods of the prior art some of the advantages thereof, while simultaneously overcoming some of the disadvantages normally associated therewith.

Still another object of the present invention is to provide a new chisel device for providing a chisel and slide hammer combination.

Yet another object of the present invention is to provide a new chisel device which includes an elongated body having a first end and a second end. An annular flange is integrally coupled to and extends around the elongated body. The flange is positioned generally between the first and second ends of the elongated body. The second end comprises a female coupler. A tubular member has an aperture extending therethrough. The elongated body extends through the aperture such that the tubular member is slidably positioned between the flange and the first end of the elongated body such that the tubular member defines a slide hammer. At least one head has a bit portion and a male coupler portion located opposite of each other. The male coupler is adapted for releasably securing to the female coupler.

Still yet another object of the present invention is to provide a new chisel device that includes a slide hammer to reduce the risk of danger of a person striking themselves with a hammer when using a chisel.

Even still another object of the present invention is to provide a new chisel device that has interchangeable bits.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
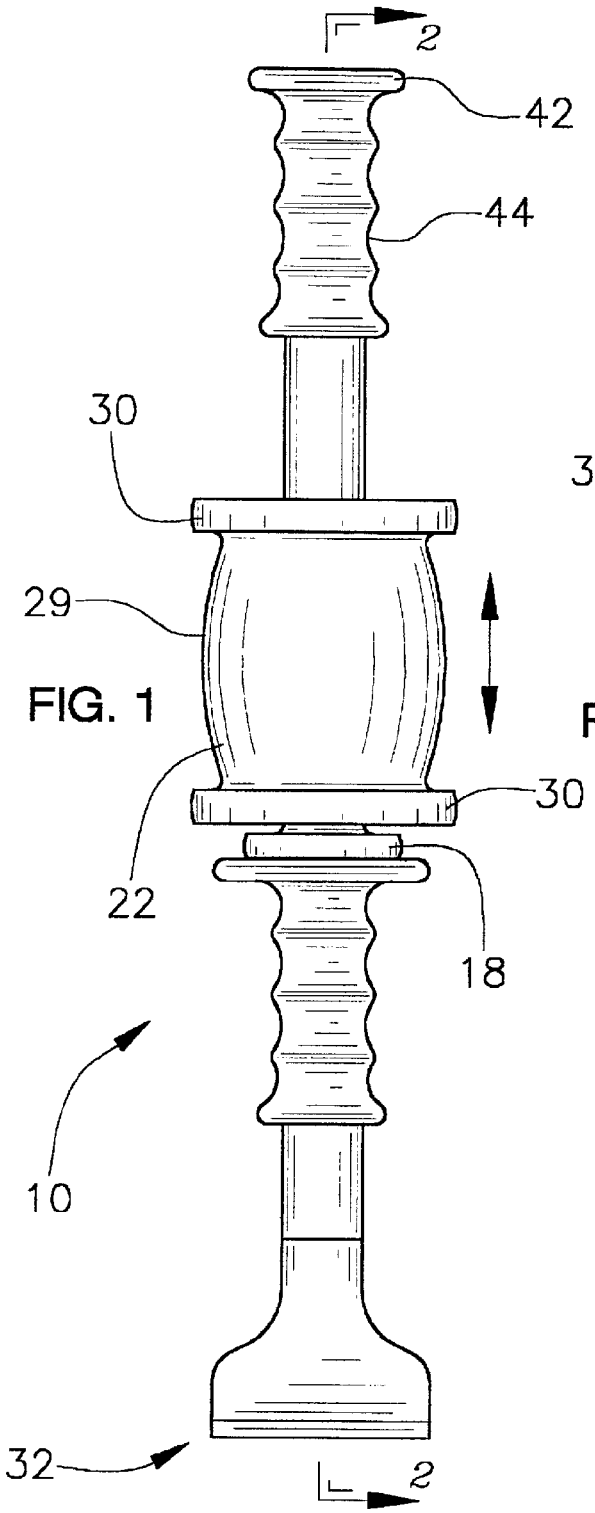
FIG. 1 is a schematic side view of a new chisel device according to the present invention.
Figure 2:
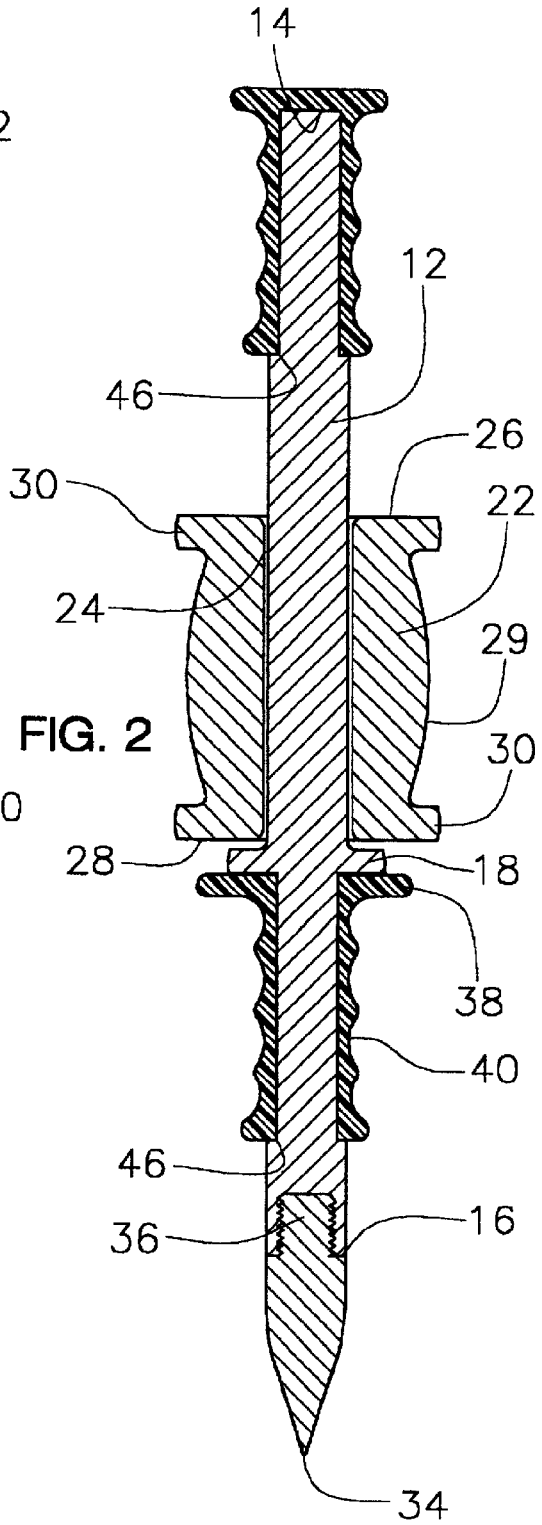
FIG. 2 is a schematic cross-sectional view taken along line 2—2 of FIG. 1 of the present invention.
Figure 3:
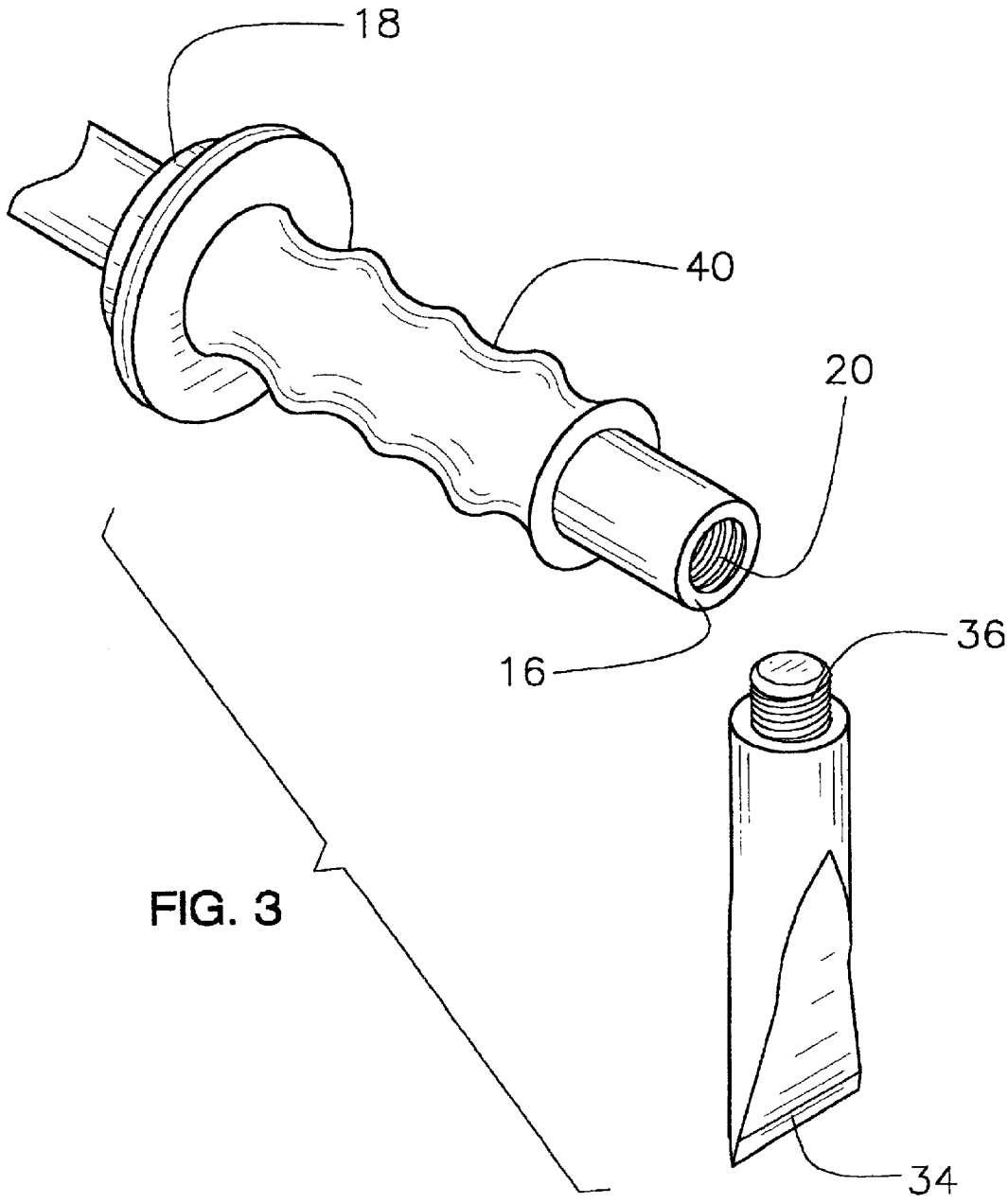
FIG. 3 is a schematic perspective view of the present invention.

With reference now to the drawings, and in particular to FIGS. 1 through 3 thereof, a new chisel device embodying the principles and concepts of the present invention and generally designated by the reference numeral 10 will be described.

As best illustrated in FIGS. 1 through 3, the chisel device 10 generally comprises an elongated body 12 having a first end 14 and a second end 16. An annular flange 18 is integrally coupled to and extends around the elongated body 12. The flange 18 is positioned generally between the first 14 and second 16 ends of the elongated body 12. The elongated body 12 has a generally circular cross-section taken transversely to a longitudinal axis of the elongated body 12. The second end 16 has a threaded bore 20 extending therein which defines a female coupler.

A tubular member 22 has an aperture 24 extending therethrough. The elongated body 12 extends through the aperture 24 such that the tubular member 22 is slidably positioned between the flange 18 and the first end 14 of the elongated body 22. The tubular member 22 defines a slide hammer. The tubular member 22 has an upper end 26, a lower end 28 and a peripheral wall 29 extending between the upper 26 and lower 28 ends. Each of a pair of annular lips 30 is attached to and extends around the peripheral wall 29. Each of the lips 30 is positioned adjacent to one of the upper 26 and lower 28 ends of the tubular member 22. wall 29. Each of the lips 30 is positioned adjacent to one of the upper 26 and lower 28 ends of the tubular member 22.

Each of a plurality of heads 32 has a bit portion 34 and a male coupler portion 36 located opposite of each other. Each of the male coupler portions 36 comprises a threaded rod adapted for threadably coupling to the bore 20.

A first handgrip 38 is attached to and extends around the elongated body 12. The first handgrip 38 is positioned generally between the second end 16 of the elongated body 12 and the flange 18. The first handgrip 38 has a plurality of finger receiving indentations 40.

A second handgrip 42 is attached to and extends around the elongated body 12. The second handgrip 42 is positioned adjacent to and extends over the first end 14 of the elongated body 12. The second handgrip 42 has a diameter greater than diameter of the aperture 24 in the tubular member 22. The second handgrip 42 has a plurality of finger receiving indentations 44. Ideally, the handgrips 38, 42 are positioned in indentations 46 in the elongated body for better securing of the handgrips.

In use, the device 10 is used a conventional chisel however instead of using a hammer to hit the end of the chisel, the user instead slides the slide hammer 22 downward against the flange 18. The heads 32 are removable so that different bits and bit replacement can occur.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chisel device comprising:

an elongated body having a first end and a second end, an annular flange being integrally coupled to and extending around said elongated body, said flange being positioned generally between first and second ends of said elongated body, said elongated body having a generally circular cross-section taken transversely to a longitudinal axis of said elongated body, said second end having a threaded bore extending therein, wherein said threaded bore defines a female coupler;

a tubular member having an aperture extending therethrough, said elongated body extending through said aperture such that said tubular member is slidably positioned between said flange and said first end of said elongated body and defining a slide hammer, said tubular member having an upper end, a lower end and a peripheral wall extending between said upper and lower ends, each of a pair of annular lips being attached to and extending around said peripheral wall, each of said lips being positioned adjacent to one of said upper and lower ends of said tubular member;

a plurality of heads each having a bit portion and a male coupler portion located opposite of each other, each of said male coupler portions comprising a threaded rod adapted for threadably coupling to said bore, each one of said plurality of heads being selectively couplable to said bore;

a first handgrip being attached to and extending around said elongated body, said first handgrip being positioned generally between said second end of said elongated body and said flange, said first handgrip having a plurality of finger receiving indentations, said first handgrip having a first annular flange extending radially outward, said first annular flange of said first handgrip being positioned juxtaposed to said annular flange of said elongated body; and a second handgrip being attached to and extending around said elongated body, said second handgrip being positioned adjacent to and extending over said first end of said elongated body, said second handgrip having a diameter greater than diameter of said aperture in said tubular member, said second handgrip having a plurality of finger receiving indentations, said second handgrip having a second annular flange extending radially outward, said second annular flange of said second handgrip being positioned at said first end of said elongated body.

* * * * *